US005092968A

United States Patent [19]

Manty

[11] Patent Number: 5,092,968

[45] Date of Patent: Mar. 3, 1992

[54] METHOD FOR PHOTOCHEMICAL MACHINING OF TITANIUM AND ZIRCONIUM

[75] Inventor: Brian A. Manty, Lake Park, Fla.

[73] Assignee: United Technologies Corporation, Hartford, Conn.

[21] Appl. No.: 709,478

[22] Filed: Jun. 3, 1991

[51] Int. Cl.[5] ..... C25D 5/02; C23F 1/02

[52] U.S. Cl. ..... 205/221; 156/661.1; 156/664

[58] Field of Search ..... 204/15; 156/634, 661.1, 156/664

[56] References Cited

U.S. PATENT DOCUMENTS 3,844,859 10/1974 Roni ..... 156/664

*Primary Examiner*—T. M. Tufariello

*Attorney, Agent, or Firm*—Herbert W. Mylius

[57] ABSTRACT

A method for use in photochemical machining of titanium or zirconium substrate articles. A coating of silver is deposited onto the substrate and a photoresist is applied onto this coating. The photoresist is selectively patterned and removed from unexposed areas thereof. The silver coating is then selectively removed from the substrate at areas not covered by the photoresist without removing material from the substrate. Photochemical etching is then performed to remove material from the substrate at areas thereof not covered by the silver coating. The remaining silver coating may then be removed to yield a titanium or zirconium workpiece having the desired pattern etched into the surface thereof.

14 Claims, 1 Drawing Sheet

METHOD FOR PHOTOCHEMICAL MACHINING OF TITANIUM AND ZIRCONIUM

BACKGROUND OF THE INVENTION

1. Field of the Invention

The invention relates to a method for use in photochemical machining of titanium or zirconium substrates.

2. Description of the Prior Art

Titanium and zirconium, and alloys thereof, are used in various applications requiring superior resistance to corrosion and chemical attack. In many of these applications it would be advantageous to utilise photochemical machining to effect selective removal of material from the surface of a titanium or zirconium article. This practice is well known as an alternative to other metal removal methods, such as cutting or grinding, of various metals and alloys, including those of iron, nickle or cobalt base.

Titanium and zirconium and their alloys, however, are highly resistant to the conventional etching solutions used in photochemical machining. Effective etchants for titanium and zirconium are hydrofluoric acid and/or ammonium bifloride. Fluorine, being the most active of all the chemical elements, will attack most conventional photoresists used in photochemical machining to mask the areas which are not to be etched. Specifically, it has been found with the etching of titanium and zirconium substrates by these etchant solutions using a conventional photoresist, that during the etching reaction the etchant penetrates portions of the photoresist to result in etching of the substrate at unwanted areas. In addition, gas evolving from the etched substrate exerts pressure on the edges of the photoresist at the unmasked area to cause lifting thereof, which permits the etchant to penetrate between the photoresist and the substrate surface. This likewise causes unwanted etching of the substrate surface.

SUMMARY OF THE INVENTION

It is accordingly a primary object of the present invention to provide a method for use in photochemical machining of titanium and zirconium substrates wherein effective masking may be achieved to prevent etching through the masked material and lifting of the masked material at edges thereof.

An additional object in the invention is to provide a method for use in photochemical machining of titanium or zirconium substrates wherein the mask materials is resistant to conventional etchants, such as hydrofluoric acid and/or ammonium bifloride, so that the unexposed areas may be effectively etched without impairment or penetration of the masked material by the etchant.

In accordance with the invention a method is provided for photochemical machining of a titanium or zirconium wherein a coating of silver is deposited onto the substrate. A photoresist is next applied onto the silver coating, with the photoresist being selectively exposed to form a pattern thereon. The photoresist is then removed from unexposed areas thereof, and the underlying silver coating may be selectively removed from the substrate at areas thereof not covered by the photoresist without removal of material from the substrate. Chemical etching is then performed to remove material from the substrate at areas thereof which are not covered by the silver coating. Chemical etching is preferably performed by the use of a hydrofluoric acid solution.

The silver coating may have a thickness within the range of 0.25 to 5 mils., preferably 1 to 2 mils., and is preferably applied by electroplating. The silver coating may be removed by anodic treatment in the silver electroplating solution used for electroplating the silver onto the substrate. The silver coating may, alternatively, be removed by contact with a nitric acid solution or a cyanide solution.

BRIEF DESCRIPTION TO THE DRAWINGS

FIGS. 1A-1E provide a schematic showing of one embodiment of a sequence of steps used in a photochemical machining operation in accordance with the invention.

DESCRIPTION OF THE PREFERRED EMBODIMENT

Figure 1A:
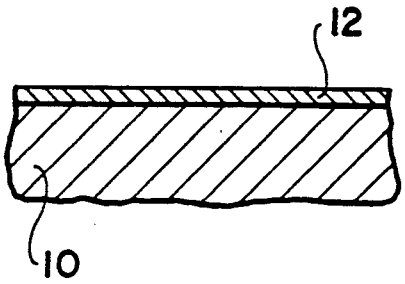
Figure 1B:
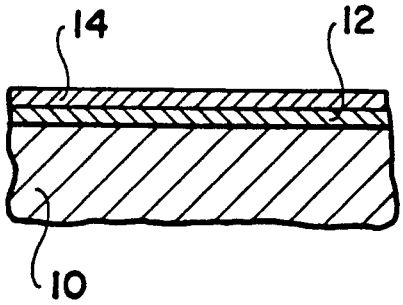
Figure 1C:
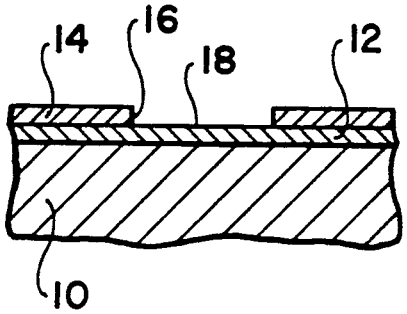
Figure 1D:
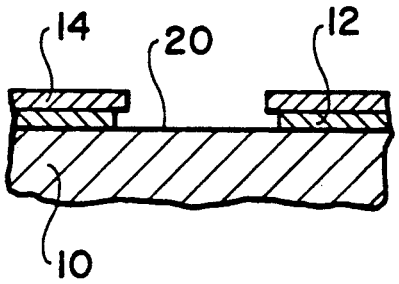
Figure 1E:
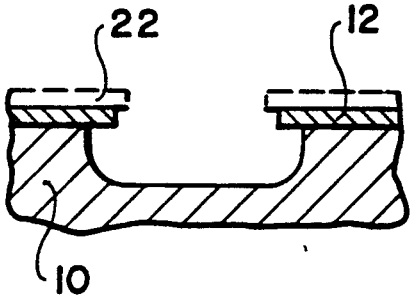

With reference to the drawings, FIG. 1A shows a substrate 10 of titanium or zirconium. The surface of the substrate has a coating of silver 12 deposited and adhering thereto. The silver coating is preferably applied by electroplating but other coating practices could be used, such as vapor deposition, sputtering, ion plating, and electroless plating. As shown in FIG. 1B, a photoresist 14 is deposited on the silver coating 12. Any conventional photoresist material may be used, such as KPR TYPE 3, obtained from KTI Chemicals Inc., an ethyl acetate containing photoresist. As shown in FIG. 1C, the photoresist is exposed and developed in the conventional manner to remove a portion thereof and provide an opening 16 exposing a surface portion 18 of the silver coating. The portion 18 of the silver coating is removed, as shown in FIG. 1D, to expose a portion 20 of the substrate 10. This is achieved without removal of the photoresist. Nitric acid solutions and cyanide solutions are suitable for this purpose. Satisfactory concentrations of a nitric acid solution may be 1% to 80% acid with the balance deionized water or distilled water, or any water essentially free of halogens, preferably 15% to 30% acid. The acid concentration is not significant as it merely affects the time required for removal of the unexposed portion 18 of the silver coating 12. If, however, acid concentrations higher than 80% are used, the heat generated incident to removal of the silver coating could possible impair the integrity of the photoresist causing removal of unwanted portions of the silver coating. Low acid concentrations of less than 1%, on the other hand, could result in undesirably long treating times for removal of the silver coating. As shown in FIG. 1E, etching in a hydrofluoric acid etching solution effectively removes the unmasked portion 20 of the substrate without attacking the silver coating 12. Remnants of the photoresist, designated as 22, may remain on the silver coating after etching, and may subsequently be removed in conventional fashion. After etching of the titanium or zirconium substrate is complete, the silver maskant may be removed by anodic treatment or by nitric acid, or cyanide immersion, to yield a titanium or zirconium workpiece having the desired pattern etched therein.

As a specific example of the practice of the invention, a panel of commercially pure titanium having a thickness of 0.011 inch was prepared for plating by applying a light vapor blast of an aluminum oxide/water slurry onto the surface to be plated. The panel after this treatment was maintained in a deionized water bath prior to plating. The titanium panel was plated in a solution containing 10 oz/gal. silver cyanide, 12 oz/gal. potassium cyanide and 8 oz/gal. potassium carbonate to provide a 1.0–1.2 mil. coating of silver on the prepared surface. The silver surface was prepared for application of a photoresist by a 5–15 second anodic treatment at 20 ASF in a 10% phosphoric acid-water solution. A conventional negative photoresist was applied, exposed and developed in accordance with the manufacturer's recommendations. This photoresist was KPR-3. Other conventional ethyl acetate photoresists such as KPR-1 or KPR-4 or, alternatively, positive photoresists may be used. These photoresists may be removed in accordance with the designated practice without resulting in removal of the silver coating. In addition, the silver coating may be removed such as by the application of nitric acid solution or cyanide solutions without affecting the photoresist. The silver portion exposed by the photresist was removed by the use of a 25% by volume nitric acid-deionized water solution by immersing the panel therein for about 1.5 to 3 minutes. The panel was then etched in a 10% hydrofluoric acid water solution to achieve the desired photochemical machining of the titanium panel. After etching, the panel was rinsed, the photoresist removed by the use of a suitable solvent and the silver coating removed by immersion in a 25% nitric acid water solution.

An examination of the panel indicated that during hydrofluoric acid etching of the titanium the silver coating was neither penetrated nor dislodged at the edges thereof from the panel surface. This resulted in a precise etching of the unmasked portion of the titanium panel. As with any photomasking technique, the silver maskant was undercut in a uniform and regular fashion, consistent with conventional chem milling of alloy substrates, as opposed to irregular edge attack which occurs during premature breakdown of normal mask on titanium.

The term silver as used herein includes elemental silver as well as alloys, such as nickel-silver alloys, where silver is the major component.

The terms titanium and zirconium as used herein include commercially pure titanium and zirconium as well as alloys wherein titanium and zirconium are the base components.

It is understood that the above description of the present invention is susceptible to various modifications, changes, and adaptations by those skilled in the art, and that the same are to be considered to be within the scope of the present invention, which is set forth by the claims which follow.

What is claimed is:

1. A method for photochemical machining of a titanium or zirconium substrate, said method comprising depositing a coating of silver onto said substrate, applying a photoresist onto said coating, selectively exposing the photoresist to form a pattern thereon, removing the photoresist from unexposed areas thereof, selectively removing said silver coating from said substrate at areas thereof not covered by said photoresist without removal of material from said substrate, performing chemical etching to remove material from said substrate at areas thereof not covered by the remaining silver coating, and subsequently removing said remaining silver coating.

2. The method of claim 1 wherein said silver coating has a thickness of 0.25 to 5 mils.

3. The method of claim 1 wherein said silver coating has a thickness of 1 to 2 mils.

4. The method of claim 2 wherein said silver coating is deposited by electroplating.

5. The method of claim 4 wherein said silver coating is removed by anodic treatment in a silver electroplating solution used for said electroplating.

6. The method of claim 2 wherein said silver coating is removed by contact with a nitric acid solution.

7. The method of claim 2 wherein said silver coating is removed by contact with a cyanide solution.

8. A method for photochemical etching of a titanium or zirconium substrate, said method comprising depositing a coating of silver onto said substrate, applying a photoresist to said coating, selectively exposing the photoresist to form a pattern thereon, removing the photoresist from unexposed areas thereof, selectively removing said silver coating from said substrate at areas thereof not covered by said photoresist without removal of material from said substrate, chemical etching with a hydrofluoric acid solution to remove material from said substrate at areas thereof not covered by the remaining silver coating, and subsequently removing said remaining silver coating.

9. The method of claim 8 wherein said silver coating has a thickness of 0.25 to 5 mils.

10. The method of claim 9 wherein said silver coating has a thickness of 1 to 2 mils.

11. The method of claim 10 wherein said silver coating is deposited by electroplating.

12. The method of claim 9 wherein said silver coating is removed by anodic treatment in a silver electroplating solution used for said electroplating.

13. The method of claim 9 wherein said silver coating is removed by contact with nitric acid solution.

14. The method of claim 9 wherein said silver coating is removed by contact with a cyanide solution.

* * * * *